US008141471B2

(12) United States Patent
DeCristofaro et al.

(10) Patent No.: US 8,141,471 B2
(45) Date of Patent: Mar. 27, 2012

(54) INITIAL STRIKE-FACE LAYER FOR ARMOR, A METHOD OF CONSTRUCTING AN ARMOR PLATE AND ARMOR

(75) Inventors: John L. DeCristofaro, Warren Township, NJ (US); John A. Dispenza, Long Valley, NJ (US); Leon Klafter, Brielle, NJ (US); Richard T. LaGrotta, Livingston, NJ (US); Ka-Shu Lee, Rockaway, NJ (US)

(73) Assignee: Alcatel Lucent, Paris (FR)

( * ) Notice: Subject to any disclaimer, the term of this patent is extended or adjusted under 35 U.S.C. 154(b) by 927 days.

(21) Appl. No.: 11/864,560

(22) Filed: Sep. 28, 2007

(65) Prior Publication Data

US 2009/0084256 A1 Apr. 2, 2009

(51) Int. Cl.
*F41H 5/02* (2006.01)

(52) U.S. Cl. ..... 89/36.02; 89/36.04; 89/36.05; 89/36.07; 89/907; 89/908; 428/911

(58) Field of Classification Search ..... 89/36.02, 89/36.04–36.05, 36.07–36.12; 428/911; 109/49.5; 2/2.5
See application file for complete search history.

(56) References Cited

U.S. PATENT DOCUMENTS

| | | | | |
|---|---|---|---|---|
| 3,523,057 | A * | 8/1970 | Buck | 428/156 |
| 3,705,558 | A * | 12/1972 | McDougal et al. | 109/84 |
| 4,179,979 | A * | 12/1979 | Cook et al. | 89/36.02 |
| 5,972,819 | A * | 10/1999 | Cohen | 501/127 |
| 6,035,438 | A * | 3/2000 | Neal et al. | 2/2.5 |
| 6,289,781 | B1 * | 9/2001 | Cohen | 89/36.02 |
| 6,575,075 | B2 * | 6/2003 | Cohen | 89/36.02 |
| 6,826,996 | B2 * | 12/2004 | Strait | 89/36.02 |
| 7,490,539 | B2 * | 2/2009 | Ma | 89/36.02 |
| 7,603,939 | B2 * | 10/2009 | Cohen | 89/36.02 |
| 7,712,407 | B2 * | 5/2010 | Ravid et al. | 89/36.01 |
| 7,721,348 | B2 * | 5/2010 | Nurnberg | 2/2.5 |
| 2004/0083880 | A1 * | 5/2004 | Cohen | 89/36.02 |
| 2007/0017360 | A1 * | 1/2007 | Cohen | 89/36.08 |
| 2007/0234458 | A1 * | 10/2007 | Larsen et al. | 2/2.5 |
| 2008/0226921 | A1 * | 9/2008 | DeCristofaro et al. | 428/412 |
| 2008/0236378 | A1 * | 10/2008 | Sane et al. | 89/36.02 |
| 2009/0114083 | A1 * | 5/2009 | Moore et al. | 89/36.02 |
| 2010/0005955 | A1 * | 1/2010 | Ohnstad et al. | 89/36.02 |
| 2010/0101402 | A1 * | 4/2010 | Ma | 89/36.02 |

* cited by examiner

*Primary Examiner* — Michael David
(74) *Attorney, Agent, or Firm* — Hitt Gaines, PC

(57) ABSTRACT

The present invention provides an initial strike-face layer for armor, a method of constructing an armor plate and armor. In one embodiment, the initial strike-face layer includes a substantially planar surface having a relief pattern with raised or recessed structures, each of the structures having sides that are oblique to the substantially planar surface.

18 Claims, 3 Drawing Sheets

INITIAL STRIKE-FACE LAYER FOR ARMOR, A METHOD OF CONSTRUCTING AN ARMOR PLATE AND ARMOR

CROSS-REFERENCE TO RELATED APPLICATION

This application is related to U.S. application Ser. No. 11/772,046 entitled, "METAL REINFORCED PLASTIC ARMOR AND A METHOD OF FABRICATING THEREOF," by Andreasen, et al., filed on Jun. 29, 2007, which is commonly assigned with the present invention and incorporated herein by reference as if reproduced herein in its entirety.

TECHNICAL FIELD OF THE INVENTION

The present invention is directed, in general, to armor and, more specifically, to an initial-strike force layer of armor.

BACKGROUND OF THE INVENTION

Armor systems are used to protect infrastructures, vehicles and the human body. Current ballistic armor technologies use a brute force method of withstanding a ballistic impact. Material is stacked in increasing thickness until it can sustain an impact without damage. Thick layers of metal are often used to provide protection of equipment and vehicles. Typically, thicker layers of metal are used for higher levels of protection.

For human protection, body armor using fabrics woven from such materials as Kevlar® or Spectra® are often used. These materials are used for protective vests in compliance with National Institute of Justice Protection Levels I and II by adding multiple layers of the material in order to stop high velocity projectiles. Multiple layers of the existing ballistic protecting fabrics can result in high costs for armor typically used by law enforcement personnel.

Material used for military vests in compliance with the National Institute of Justice Protection Levels III and IV typically consist of strike face materials such as rigid panels made from ceramics or metal plates inserted into pockets on all sides of a vest. These vest are usually inflexible and heavy depending on the level of protection. Monolithic ceramic plates are costly to manufacture and usually withstand a single high velocity impact. Once cracked, the protection provided by the plates is drastically reduced.

Therefore, improvements in armor would prove beneficial in the protection of people, structures, vehicles, etc.

SUMMARY OF THE INVENTION

The present invention provides an initial strike-face layer for armor, a method of constructing an armor plate, and armor.

In one aspect, the invention provides an initial strike-face layer for armor including a substantially planar surface having a relief pattern with raised or recessed structures. Each of the structures having sides which are oblique to the substantially planar surface.

In another aspect, the invention provides a method of constructing an armor plate including: (1) forming a substantially planar surface of an initial strike-face layer having a relief pattern with raised or recessed structures, each of the structures having sides that are oblique to the substantially planar surface and (2) coupling a projectile-barrier to the initial strike-face layer.

In yet another aspect, the invention provides an armor, including: (1) an initial strike-face layer constructed of a composite material having a substantially planar surface including a relief pattern with raised or recessed structures, each of the structures having sides that are oblique to the substantially planar surface and (2) at least one projectile-barrier layer coupled to said initial strike-face layer.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

The present invention utilizes surface shaping of ballistic material to deflect incoming projectiles. When a projectile impacts a surface at an angle, the full momentum of the impact can be divided into mutually orthogonal elements. The mutually orthogonal elements include a component that is perpendicular to the surface and a component that is tangent to the impacting surface. Whereas the momentum in a direct (i.e., perpendicular) impact is substantially characterized by the perpendicular component alone, the momentum vector that characterizes a glancing blow has a substantial tangential component as well.

If a direct impact at the initial point of contact between the projectile and the surface of the ballistic material is deflected, then impact momentum perpendicular to the surface is lessened and damage is reduced. The tangential portion of the impact momentum provides a minimal effect on the surface until striking another location with a lower impact force than the original force of the incoming projectile. Once the projectile is diverted from its direct (or perpendicular) path at the armor surface, the projectile will, if at all, strike and penetrate the armor at an oblique angle. When penetrating the armor at an oblique angle, the effective thickness of the armor is larger than the actual thickness as viewed from the trajectory of a projectile that is perpendicularly incident on the local surface of the armor. Similar ballistic protection with thinner, lighter armor structures, therefore, may be achieved by shaping the surface of the armor to create glancing impacts. Thus, instead of employing a substantially flat or planar surface, the present invention provides armor having a shaped surface that reduces perpendicular impacts from projectiles. Therefore, instead of strictly relying on material properties to reduce the effective impact energy of high speed projectiles, surface shaping is used to deflect the projectile, thus changing its local impact characteristics. Such redistribution of some of the projectile's momentum with respect to the local surface of the armor could have a beneficial effect on weight of the armor and cost of the material for the armor.

Figure 1:
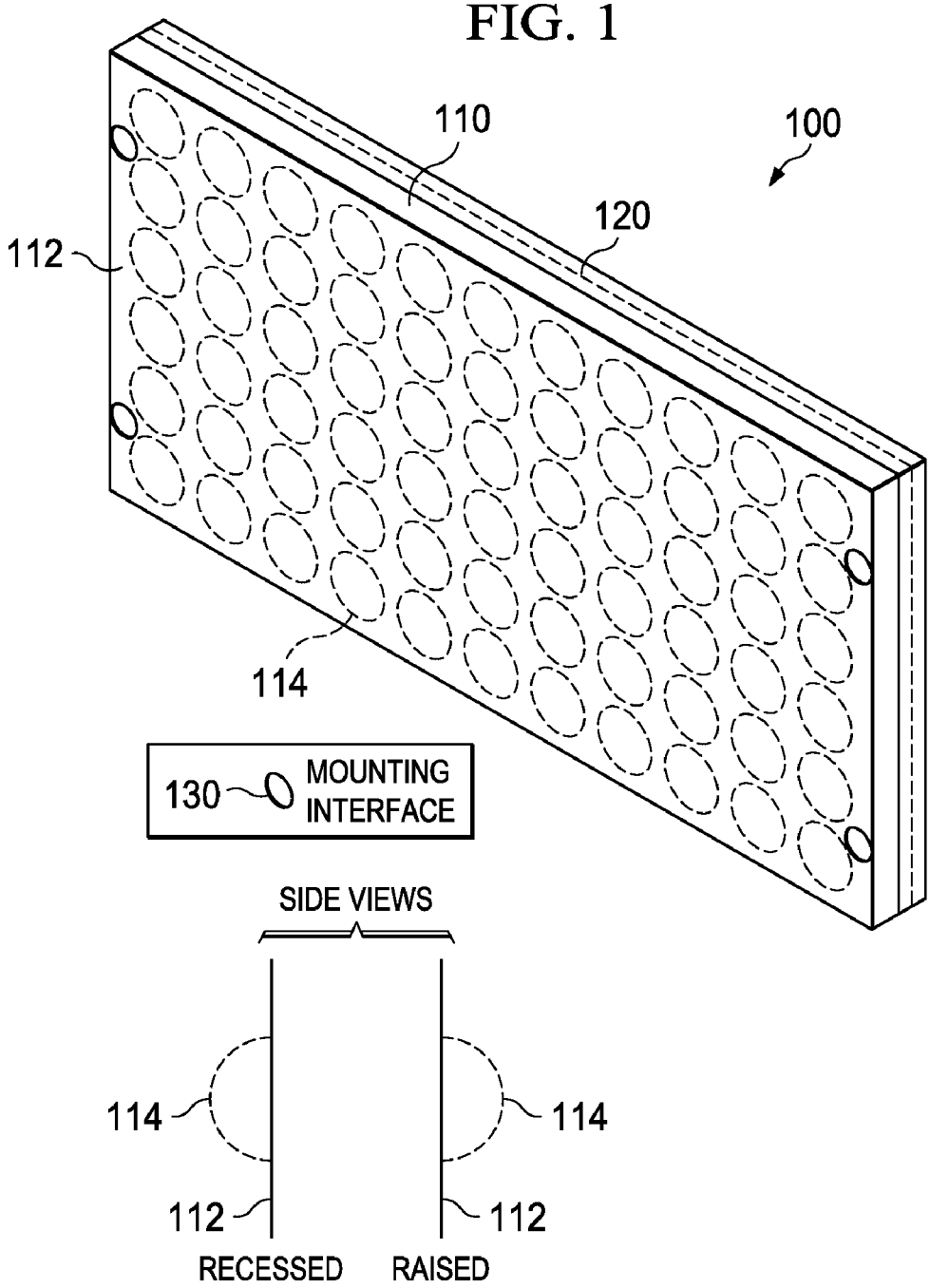
FIG. 1 illustrates a diagram of an embodiment of armor constructed according to the principles of the present invention.

Turning now to FIG. 1, illustrated is a diagram of an embodiment of armor, generally designated 100, constructed according to the principles of the present invention. The armor 100 includes an initial strike-face layer 110, a projectile-barrier layer 120 and a mounting interface 130. The armor 100 is designed to prevent penetration of projectiles. Typically, the armor 100 is formed into plates and attached to vehicles (e.g., trucks, helicopters and boats) to prevent penetration of projectiles into the vehicles. The armor 100 may also be used to protect static structures such as buildings, tents, bridges, etc.

The initial strike-face layer 110 is constructed of a composite material having a substantially planar surface 112. The substantially planar surface 112 is a major surface that provides an average impact plane that is perpendicular to incoming projectiles. The substantially planar surface 112 may be consistently flat or may have a curved portion. Formed in the substantially planar surface 112 is a relief pattern of geometric structures, generally designated 114, designed to deflect impinging projectiles and reduce perpendicular impacts from the impinging projectiles. The structures 114 are raised or recessed with sides that are constructed to laterally deflect projectiles normally incident on a plane tangential to the average impact plane of the substantially planar surface 112. The structures 114 may be arranged in a relief pattern with the sides of the structures 114 producing a corrugated surface in one or two directions.

The structures 114 can be given any of various shapes and sizes depending on the desired application or use. Additionally, the specific pattern of the structures 114 may be chosen depending on a particular application. For example, the structures 114 may be applied in a regular or partially regular one-dimensional or two-dimensional pattern. Furthermore, the structures 114 may be raised (i.e., a positive relief) or recessed (i.e., a negative relief). If raised, the structures 114 extend from the substantially planar surface 112 and toward a source of the projectile. If recessed, the structures 114 extend into the substantially planar surface 112 and away form a source of the projectile.

In FIG. 1, the structures 114 are rounded structures, such as domes, that present a curved surface to impinging projectiles. The domes may be shaped as hemispheres or have another curved-shape. A plane tangential to a side of the domes is at an oblique angle with respect to substantially planar surface 112. In other embodiments, three-dimensional geometric structures having sloping straight sides may be used to provide obliquely angled surfaces to impinging projectiles. Thus, the structures 114 may by formed with sides that are at an acute or obtuse angle with respect to the substantially planar surface 112. As such, the structures 114 may be three- or four-sided pyramids. The pyramids may be complete pyramids, truncated pyramids or even a mixture of both. In some embodiments, the structures may overlap.

In FIG. 1, the structures 114 are in a regular pattern on the substantially planar surface 112. Alternatively, the structures 114 may be irregularly located on the substantially planar surface 112. In FIG. 1, the structures 114 cover a hundred percent or substantially one hundred percent of the substantially planar surface 112. The percentage of coverage may vary according to the desired application. As noted above, the domes may be raised (i.e., extend above the substantially planar surface 112) or may be recessed (i.e., a rounded depression into the substantially planar surface 112).

The composite material of the initial strike-face layer 110 may, for example, comprise a formable polymer, such as a thermoplastic, including ceramic grains between the polymer molecules. An example of a suitable type of thermoplastic polymer is polycarbonate. The ceramic grains can be molded within a metal mesh by the polycarbonate to form the initial strike-face layer 110. The ceramic grains may be aluminum oxide granules. In other embodiments, the ceramic grains may be boron carbide granules. Larger granules of the ceramic grains may be used to increase protection against larger sized projectiles. Using a heat press, the polycarbonate, or another suitable impact resistant thermoplastic, can be formed into the initial strike-face layer 110 including the substantially planar surface 112 having the structures 114.

In other embodiments, the initial strike-face layer 110 may be constructed of a different composite material. In some embodiments, the composite material may include a thermoset resin. As such, the initial strike-face layer 110 may be formed by placing or pouring the thermoset resin into a form or cavity to produce the desired shape for the initial strike-face layer 110. In alternative embodiments, the initial strike-face layer may be constructed of a metal such as titanium. Employing the composite materials, however, can reduce shrapnel resulting from an impacting projectile and allow protection against multiple impinging projectiles.

The projectile-barrier layer 120 may be constructed of a polycarbonate-fiberglass composite and is coupled to the initial strike-face layer 110. The projectile-barrier layer 120 may be coupled to the initial strike-face layer by applying an adhesive bonding agent, by applying heat, by applying pressure, by using another conventional bonding method or by a combination of the above methods. The adhesive bonding agent may be, e.g., an epoxy resin. One skilled in the art will understand that other projectile-resistant materials instead of a polycarbonate-fiberglass composite may be used as the projectile-barrier layer 120.

In some embodiments, energy absorbing material, including high-strength polymers such as Kevlar® distributed by DuPont, may be used in the barrier layer instead of a polycarbonate-fiberglass composite to capture or slow down an impinging projectile instead of resisting the impinging projectile. Multiple projectile-barrier layers may be used in the armor 100. Additionally, the armor 100 may include multiple strike-face layers. The multiple projectile-barrier layers and strike-face layers can be molded together using heat and pressure.

In some embodiments, the projectile-barrier layer 120 and the initial strike-face layer 110 can be molded together using heat and pressure in, for example, a heat press. An application of 500 degrees Fahrenheit or approximately thereof with 10,000 psi or approximately thereof may be applied for approximately or at half an hour to the projectile-barrier layer 120 and the initial strike-face layer 110 to mold these layers together. As discussed above, the initial strike-face layer 100 may be a polycarbonate including aluminum oxide granules between the polymer molecules.

The armor 100 also includes the mounting interface 130 that is configured to attach the armor 100 to the object-to-be-protected. The object-to-be-protected may be, e.g., a vehicle, a structure, a support stand, etc. The mounting interface 130 can also be fabricated during the molding process of the armor 100. The mounting interface 130 may reduce the demands of time, material, fabrication, etc., needed to attach the armor 100 in the field. In some embodiments, the mounting interface 130 may include holes through the armor 100 and mechanical fixtures such as screws or bolts. The mounting interface 130 may also include a recessed area to fit with a specific use. The mounting interface 130 may be specifically designed for attachment to a particular object-to-be-protected or may be a universal mounting interface. In some embodiments, the armor 100 may omit a mounting interface 130. As such, a means for attaching the armor 100 to an object-to-be-protected can be fabricated in the field.

Figure 2:
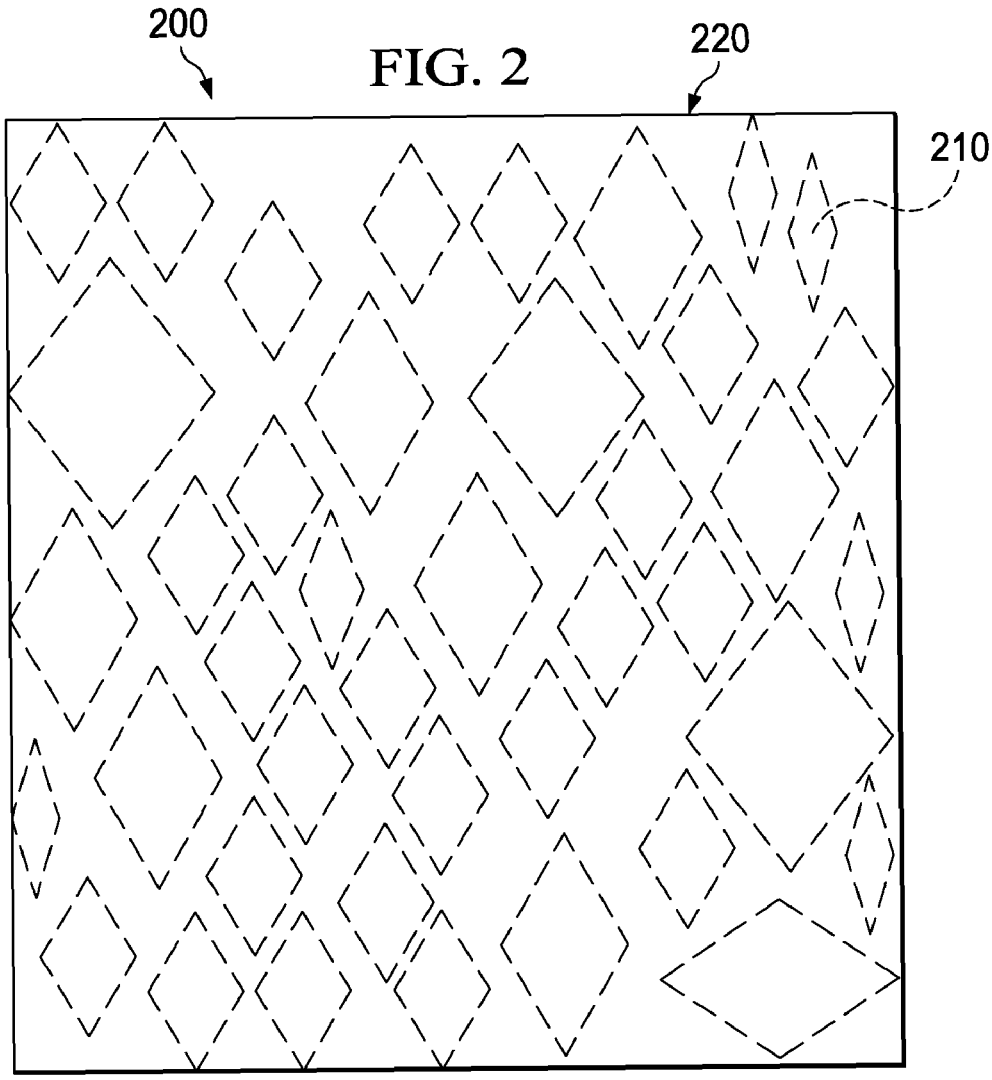
FIG. 2 illustrates a diagram of an embodiment of an initial strike-face layer constructed according to the principles of the present invention.

FIG. 2 illustrates a diagram of an embodiment of an initial strike-face layer 200 constructed according to the principles of the present invention. The initial strike-face layer 200 is configured to locally deflect impinging projectiles for armor and can be used in multiple configurations. The armor may be used to protect individuals (e.g., body armor), equipment, structures, vehicles, etc. The initial strike-face layer 200 may be coupled to a projectile-barrier layer or layers to form the armor.

The initial-strike force layer 200 has a substantially planar surface 220 including geometric structures, generally designated 210, designed to locally deflect impinging projectiles. The initial-strike force layer 200 is a composite material that may be molded into shape by applying pressure and heat in a heat press. Through the molding process, the structures 210 are formed as a relief pattern on the substantially planar surface 220. The composite material, as discussed with respect to FIG. 1, may be an impact resistant thermoplastic including ceramic grains bound together within a metal mesh. Of course, other composite materials typically used to resist projectiles may be used.

In the illustrated embodiment, the structures 210 are pyramids and/or pyramidal depressions that provide an angled surface for impacting projectiles. As illustrated, the pyramids or pyramidal depressions can vary in size. The size may vary in width and/or height. In alternative embodiments, other structures 210 may have the same size or may have a different shape, such as, rounded structures (e.g., domes). The structures 210 may have different shapes within one embodiment. A pattern of the structures 210 may be consistent over the substantially planar surface 220. In some embodiments, the location of the structures 210 may form an irregular pattern on the substantially planar surface 220. In some embodiments, the structures 210 may have a height (or depth) of, or approximately of, three-fourths of an inch (¾").

Figure 3:
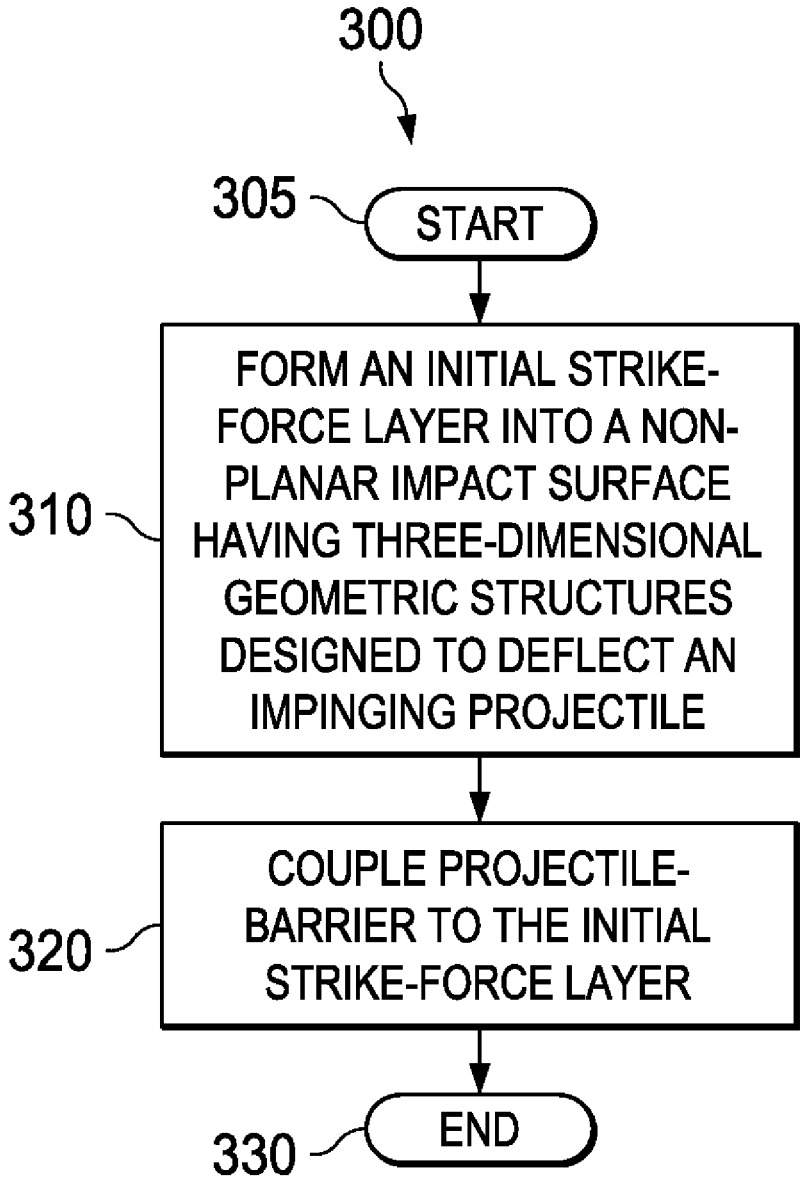
FIG. 3 illustrates a flow diagram of an embodiment of a method of constructing an armor plate carried out according to the principles of the present invention.

FIG. 3 illustrates a flow diagram of a method of constructing an armor plate carried out according to the principles of the present invention. The method begins in a step 305 with an intent to make the armor plate.

After beginning, a substantially planar surface of an initial strike-face layer is formed in a step 310. The substantially planar surface includes raised or recessed structures designed to deflect an impinging projectile. The substantially planar surface may be a consistently flat surface or have a portion that is curved. Regardless, the substantially planar surface provides an average impact plane that is substantially perpendicular to incoming projectiles. Forming the initial strike-face layer may include molding a composite material into a desired shape based on the object-to-be-protected.

The structures used may be pyramids, domes, or other structures with sloping sides that are oblique to the average impact plane of the substantially planar surface. The structures that are formed are designed to reduce the local perpendicular momentum transfer of a projectile on the initial strike-face layer.

After forming the initial strike-face layer, a projectile-barrier is physically coupled to the initial strike-face layer in a step 320. The projectile-barrier may be coupled to the initial strike-face layer using a heat press to mold the projectile-barrier and initial strike-face layers together through the application of heat and pressure for a designated time. An application of 500 degrees Fahrenheit or approximately thereof with 10,000 psi or approximately thereof may be applied for approximately or at half an hour to the projectile-barrier and the initial strike-face layer to mold these layers together. In some embodiments, an adhesive bonding agent may be used to physically couple the two layers together. The projectile-barrier may include multiple layers that have been physically coupled together, such as being molded together by heat and pressure, based on the level of protection needed. The multiple layers may be molded together using a heat press as described above. The method 300 then proceeds to a step 330 and ends.

Although the present invention has been described in detail, those skilled in the art should understand that they can make various changes, substitutions and alterations herein without departing from the spirit and scope of the invention in its broadest form.

What is claimed is:

1. An apparatus, comprising:

an armor, including:

a monolithic initial strike-face layer formed of a composite material and having a substantially planar surface with a relief pattern formed therein of raised or recessed structures, each of said structures having sides that are oblique to said substantially planar surface, said composite material comprising a thermoplastic polymer, a metal mesh and ceramic grains between molecules of said thermoplastic polymer and molded within said metal mesh; and at least one projectile-barrier layer coupled to said initial strike-face layer.

2. The apparatus as recited in claim 1 wherein said sides are curved and a tangential plane to said sides is oblique to said substantially planar surface.

3. The apparatus as recited in claim 2 wherein said structures are domes.

4. The apparatus as recited in claim 1 wherein each of said structures is raised with respect to said substantially planar surface.

5. The apparatus as recited in claim 1 wherein said sides are sloping sides that are oblique to said substantially planar surface.

6. The apparatus as recited in claim 5 wherein said structures are pyramids or pyramidal depressions.

7. The apparatus as recited in claim 1 wherein said relief pattern includes said structures arranged in a regular pattern.

8. The apparatus as recited in claim 1 further comprising at least one mounting interface.

9. The apparatus as recited in 1 wherein sizes of said structures vary.

10. The apparatus as recited in 1 wherein said projectile-barrier layer includes multiple layers.

11. The apparatus as recited in claim 1 wherein said raised or recessed structures have a height or depth of at least three-fourths an inch from said substantially planar surface.

12. A method of constructing an armor plate, comprising:

forming a composite material into a substantially planar surface;

forming a relief pattern of raised or recessed structures in said composite material to construct a monolithic initial strike-face layer, wherein each of said structures have sides that are oblique to said substantially planar surface, and wherein said composite material comprises a thermoplastic polymer, a metal mesh and ceramic grains between molecules of said thermoplastic polymer and molded within said metal mesh; and attaching a projectile-barrier to said initial strike-face layer.

13. The method as recited in claim 12 further comprising forming said structures to have straight sloping sides.

14. The method as recited in claim 12 further comprising forming each of said structures to be recessed with respect to said substantially planar surface.

15. The method as recited in claim 12 further comprising forming said structures as domes.

16. The method as recited in claim 12 wherein said sides are curved.

17. The method as recited in claim 12 wherein each of said structures is raised with respect to said substantially planar surface.

18. The method of claim 12 wherein said attaching includes molding said projectile-barrier to said initial strike-face layer employing pressure and heat.

* * * * *